US010697689B2

(12) United States Patent
Lindel et al.

(10) Patent No.: US 10,697,689 B2
(45) Date of Patent: Jun. 30, 2020

(54) HOUSEHOLD APPLIANCE DEVICE AND METHOD FOR OPERATING A HOUSEHOLD APPLIANCE DEVICE

(71) Applicant: BSH HAUSGERAETE GMBH, Munich (DE)

(72) Inventors: Andreas Lindel, Heidenheim (DE); Elmar Faehnle, Elchingen (DE); Felix Wiedenmann, Heidenheim (DE); Thomas Schaefer, Giengen (DE)

(73) Assignee: BSH Hausgeraete GmbH, Munich (DE)

( * ) Notice: Subject to any disclaimer, the term of this patent is extended or adjusted under 35 U.S.C. 154(b) by 120 days.

(21) Appl. No.: 15/844,859

(22) Filed: Dec. 18, 2017

(65) Prior Publication Data

US 2018/0172330 A1 Jun. 21, 2018

(30) Foreign Application Priority Data

Dec. 19, 2016 (DE) ..... 10 2016 225 370

(51) Int. Cl.

| | |
|---|---|
| ***F25D 17/04*** | (2006.01) |
| ***F25D 23/06*** | (2006.01) |
| ***F25D 11/00*** | (2006.01) |
| ***F25D 25/02*** | (2006.01) |
| *F25D 11/02* | (2006.01) |

(52) U.S. Cl.
CPC ..... *F25D 17/04* (2013.01); *F25D 11/00* (2013.01); *F25D 23/062* (2013.01); *F25D 2317/067* (2013.01)

(58) Field of Classification Search
CPC ..... F25D 17/04; F25D 11/00; F25D 23/062; F25D 2317/067
USPC ..... 62/407
See application file for complete search history.

(56) References Cited

U.S. PATENT DOCUMENTS

| | | | | |
|---|---|---|---|---|
| 7,299,651 | B2 * | 11/2007 | Oh | F25D 17/062 62/407 |
| 2010/0125365 | A1 * | 5/2010 | Ahn | F25D 17/065 700/275 |
| 2011/0011106 | A1 * | 1/2011 | Ahn | F25D 17/065 62/89 |
| 2012/0036879 | A1 * | 2/2012 | Candeo | F25D 17/045 62/187 |

* cited by examiner

*Primary Examiner* — Steve S Tanenbaum
(74) *Attorney, Agent, or Firm* — Laurence A. Greenberg; Werner H. Stemer; Ralph E. Locher

(57) ABSTRACT

The efficiency of a household appliance device, in particular of a household refrigerator device, is improved. An inner container has at least one inner panel that delimits an interior at least partially. An air exchange unit is formed with at least two flow channels that run substantially parallel and that are in fluidic communication with the interior.

16 Claims, 4 Drawing Sheets

HOUSEHOLD APPLIANCE DEVICE AND METHOD FOR OPERATING A HOUSEHOLD APPLIANCE DEVICE

CROSS-REFERENCE TO RELATED APPLICATION

This application claims the benefit, under 35 U.S.C. § 119, of German patent application DE 10 2016 225 370.0, filed Dec. 19, 2016; the prior application is herewith incorporated by reference in its entirety.

BACKGROUND OF THE INVENTION

Field of the Invention

The invention relates to a household appliance device and to a method for operating a household appliance device.

Household refrigerators are known from the prior art which comprise an inner container and a support unit which is used for at least partially retaining a plurality of shelves. As a rule, an air exchange unit is centrally located in the inner container and forms an elevation relative to a back panel of the inner container.

SUMMARY OF THE INVENTION

It is accordingly an object of the invention to provide a refrigeration device and a corresponding method which overcome a variety of disadvantages of the heretofore-known devices and methods of this general type and which provide for a device having improved properties in respect of efficiency.

With the foregoing and other objects in view there is provided, in accordance with the invention, a household appliance device, in particular a household refrigerator. The device comprises:

an inner container having an inner panel at least partially delimiting an interior; and an air exchange unit defining at least two flow channels, said at least two flow channels running fluidically substantially parallel, at least in certain sections thereof, and each fluidically communicating with the interior.

In other words, there is provided a household appliance device, in particular a household refrigerator appliance, according to the invention, with an inner container, which has at least one inner panel, which at least partially delimits an interior, advantageously a useful space. The device also has an air exchange unit, which defines at least two flow channels fluidically running at least substantially parallel, at least in certain sections, and in particular spaced apart from each other, which are each fluidically connected, in particular directly, to the interior.

A "household appliance device" should in this context be taken to mean, in particular, at least part, in particular a subassembly, of a household appliance. The household appliance is particularly preferably designed as a household refrigerator, in particular as a fridge, a freezer, an upright freezer, a chest freezer, a fridge freezer and/or a wine storage cabinet and is provided in particular in at least one operating state to cool chilled goods, in particular food, such as, for example, drinks, meat, fish, milk and/or dairy products. In particular, the household appliance comprises for this purpose at least one appliance body, which has, in particular, the inner container and advantageously an outer container inside which the inner container is arranged in an assembled state. A gap is preferably foam-filled between the inner container and the outer container in an assembled state. The inner container is particularly preferably produced and/or formed in a thermoforming process and is made in particular at least partially, preferably to at least a large extent and particularly preferably completely, from a thermoplastic. Furthermore, the household appliance advantageously comprises at least one appliance closure element, which is provided in particular to at least partially cover, in particular close, in particular in a closed state, the interior, in particular an access opening of the interior. The appliance closure element can, in particular, be designed at least partially as an appliance drawer and in particular so as to be linearly moveable. The appliance closure element is advantageously designed as an appliance cover and/or preferably as appliance doors and is preferably pivotally mounted about a pivot axis, in particular about a horizontal axis and/or preferably about a vertical axis, in particular relative to a set up position and/or an installation position, in particular relative to the appliance body. Furthermore, the household appliance device can have at least one storage element, which is arranged in particular in the interior and is provided in particular for the storage of food and/or drinks. The storage element can advantageously be designed as a door rack, a bottle holder, a storage container, a rack, a storage plate and/or as a shelf. "Provided" should, in particular, be taken to mean specifically designed and/or equipped. Thereunder, that an object is provided for a particular function should, in particular, be taken to mean that the object fulfills and/or performs this particular function in at least one application and/or operating state. The term "to at least a large extent" should, in particular, be taken to mean at least 55%, advantageously at least 65%, preferably at least 75%, particularly preferably at least 85% and particularly advantageously at least 95%.

Furthermore, an "air exchange unit" should, in particular, be taken to mean a unit advantageously at least partially arranged on the inner panel, and which is provided, in particular, to at least partially guide and/or convey an air flow. The air exchange unit advantageously encompasses the air flow at least partially and preferably to at least a large extent and/or completely. The air exchange unit comprises, in particular, at least one first air flow opening in particular facing the interior and in particular at least indirectly and/or advantageously directly connected to a first flow channel of the flow channels, and at least one second air flow opening in particular facing the interior and in particular at least indirectly and/or advantageously directly connected to a second flow channel of the flow channels. A first flow channel of the flow channels is preferably fluidically connected to a first section of the interior and a second flow channel of the flow channels to a second section of the interior. In particular, the flow channels can also be connected to each other and form a shared flow channel. Furthermore, the air exchange unit can have at least one air inlet opening, in particular for cooling air, in particular connected at least indirectly and/or directly to a cooling unit, for example an evaporator unit. Furthermore, the air exchange unit preferably comprises at least two air exchange elements, which, in particular, at least partially delimit the flow channels. At least one of the air exchange elements is preferably made at least partially, preferably to at least a large extent and particularly preferably completely, from a plastics material and/or an, in particular, expanded polystyrene and/or an, in particular, expanded polypropylene. "At least essentially parallel" should here be taken to mean, in particular, an orientation of a direction relative to a reference direction in particular in one plane, wherein the direction has a deviation with respect to the reference direction in particular of less than 8°, advantageously less than 5° and particularly advantageously less than 2°. Furthermore, "fluidically at least essentially parallel" should, in particular, be taken to mean that at least one main flow pattern is at least essentially parallel.

Furthermore, the household appliance device can, in particular, have an inner panel unit which, at least when the inner panel is being viewed perpendicularly, is arranged between the flow channels. The inner panel unit can separate the first section from the second section. An "inner panel unit" should, in particular, be taken to mean a unit, advantageously at least partially arranged on the inner panel and advantageously designed separately and/or apart from the air exchange unit, which unit is advantageously provided to discharge at least one function, in particular correlated with the household appliance. The inner panel unit is preferably arranged in a vicinity of the air exchange unit. The inner panel unit is preferably arranged, at least when the inner panel is being viewed perpendicularly, in a region different from an edge region of the inner panel and advantageously centrally on the inner panel. The inner panel unit can in particular be designed as a function unit, a retaining unit, a support unit and/or a separation unit. A "vicinity" should, in particular, be taken to mean a spatial region which is formed from points which are spaced apart less than a third, preferably less than a quarter, preferably less than a sixth and particularly preferably less than a tenth, of a main length of extension of the inner container and/or interior from a reference point and/or a reference component, in particular of the inner panel unit, and/or which each have a spacing of at most 20 cm, advantageously at most 15 cm, preferably at most 10 cm and particularly preferably at most 5 cm, from a reference point and/or a reference component, in particular of the inner panel unit. A "main length of extension" of an object should in this context be taken to mean, in particular, an extension of the object in a main direction of extension of the object. A "main direction of extension" of an object should, in particular, be taken to mean a direction which runs parallel to a direction of a longest side and/or edge of the object. The efficiency of the household appliance device in particular can be improved by the design. Furthermore, efficient temperature stratification, preferably a convection effect and particularly advantageously air circulation, can be achieved. Furthermore, advantageous cleaning of the inner panel can be achieved, in particular since a contamination effect can be reduced by the at least essentially flat inner panel plane. Furthermore, an air exchange unit with an inconspicuous design can in particular be provided which can advantageously be implemented so as to be almost invisible for a user. In addition, the complexity in particular can be reduced, and/or a uniform concept achieved across different appliance ranges. In particular, the main direction of extension of the inner panel unit can run essentially parallel to the flow channels. It is also possible, in particular, for the inner panel unit to be arranged between the two flow channels, when the inner panel is being viewed perpendicularly.

It can in particular be provided that the two flow channels and/or the inner panel unit essentially run vertically, when the inner panel is being viewed perpendicularly and with a correctly set up household appliance device or household appliance.

The inner panel is preferably a back panel of the inner container, in particular opposing the access opening, so an advantageously simple implementation of the air exchange unit in particular can be achieved.

It can be provided that the household appliance device has an interior cover which covers the inner panel and/or the air exchange unit essentially completely with respect to the interior. The interior cover is preferably provided with air egress openings to ensure egress of air from the air exchange unit into the interior.

Furthermore, it is proposed that the air exchange unit, at least when the interior is being viewed, is designed at least essentially level with the inner panel, in particular an inner side of the inner panel, in particular at least in one region of the air exchange unit. "A region of an object" should, in particular, be taken to mean a volume of a smallest imagined cuboid which still just completely surrounds the object. In addition, "at least essentially level" should, in particular, be taken to mean free from an elevation that reduces the size of the interior, in particular by at least 5%, in particular by at least 2.5% and in particular by at least 1%. The air exchange unit and the inner panel advantageously define, at least in the region of the air exchange unit, a shared inner panel plane, with the air exchange unit being arranged to at least a large extent behind the shared inner panel plane. The air exchange unit can particularly preferably be let into the inner panel, for example, and/or be integrated flush in the inner panel. An interior can in particular be enlarged and/or useful space efficiency improved hereby.

Furthermore, it is proposed that the air exchange unit is arranged at least partially, preferably to at least a large extent and particularly preferably completely, on a side of the inner container, in particular the inner panel, facing the interior. The air exchange unit is preferably positively and/or non-positively connected to the inner panel, advantageously a side of the inner panel facing the interior, such as, for example, by means of a latching connection and/or a screw connection. In particular, assembly of the household appliance device can be simplified hereby.

In a further embodiment of the invention it is proposed that the air exchange unit is arranged at least partially and preferably to at least a large extent on a side of the inner container, in particular the inner panel, remote from the interior. The air exchange unit is advantageously firmly bonded to the inner panel, advantageously a side of the inner panel remote from the interior, such as, for example, by means of a glued joint. An advantageously simple design of the inner container in particular can be achieved hereby, so costs in particular can be minimized. It is also conceivable for the air exchange unit to also or alternatively be positively and/or non-positively connected to the inner panel, advantageously a side of the inner panel remote from the interior.

Furthermore, it is proposed that the flow channels form a shared flow channel, in particular the shared flow channel already mentioned above. In particular, the two flow channels can be connected to one or two or more connection channel(s). It is possible, in particular, for the connection channel or channels to essentially be arranged perpendicular to the main direction of extension of the flow channels. The connection channel or channels can be arranged on an end section of the flow channels and/or between two end sections of the flow channels. The shared flow channel can be at least essentially U-shaped at least in certain sections. An "at least essentially U-shaped" object should, in particular, be taken to mean an object which differs from a U-shaped reference object with a surface fraction and/or volume fraction of at most 20%, advantageously at most 10% and particularly preferably at most 5%. A particularly simple constructional design of the air exchange unit and/or advantageously simple fixing of the inner panel unit can in particular be achieved hereby.

The air exchange unit could, for example, be designed in one piece with the inner panel. However, it is advantageously proposed that the inner panel defines at least one locating recess, inside which the air exchange unit is arranged, in particular with positive and/or non-positive fit. The locating recess can, in particular, delimit the flow channels at least in certain sections. For example, when the inner panel is being viewed perpendicularly, the locating recess can form a back or front delimiting wall of the flow channels. Alternatively or additionally, the locating recess can delimit the flow channels laterally, i.e. when the inner panel is being viewed perpendicularly in the depth direction. The locating recess is advantageously at least essentially U-shaped. "In one piece" should in this context be taken to mean in particular at least firmly bonded and/or formed together. The firm bond can be produced, for example, by a gluing process, an injection process, a welding process, a soldering process and/or a different process. Advantageously, in one piece should be taken to mean formed from one piece and/or in one piece. This one piece is preferably produced from a single blank, a compound and/or a casting, such as, for example, in an extrusion process, in particular a single- and/or multi-component extrusion process, and/or an injection molding process, in particular a single- and/or multi-component injection molding process. An advantageous flexibility in particular can be achieved hereby. In addition, maintenance, in particular, can be simplified.

Furthermore, it is proposed that the household appliance device comprises an inner panel unit, in particular the inner panel unit already mentioned above which is arranged, at least when the inner panel is being viewed perpendicularly, between the flow channels, and which is designed, at least when the interior is being viewed, at least essentially level with the inner panel, in particular the inner side of the inner panel, in particular at least in one region of the inner panel unit surrounding the air exchange unit. In an assembled state the inner panel, the inner panel unit and the air exchange unit preferably define and/or form a shared inner panel plane and/or an at least essentially flat inner side. Particularly high useful space efficiency can in particular be achieved hereby.

If the inner panel unit is at least partially arranged, preferably to at least a large extent and particularly preferably completely, on a side of the inner container, in particular the inner panel, facing the interior, assembly efficiency and/or production efficiency can advantageously be improved. The inner panel unit is preferably positively and/or non-positively connected to the inner panel, advantageously a side of the inner panel facing the interior, such as, for example, by means of a latched connection and/or a screw connection.

The inner panel unit could, for example, be formed in one piece with the inner panel. In a preferred embodiment of the invention it is proposed, however, that the inner panel defines at least one further locating recess inside which the inner panel unit is arranged, in particular with positive and/or non-positive fit. In particular, the further locating recess can also be at least partially identical to the locating recess, in particular for the air exchange unit. It is possible, in particular, for the further locating recess to be arranged inside the locating recess for the air exchange unit, when the inner panel is being viewed perpendicularly.

An advantageous flexibility and/or adaptability in particular can be achieved hereby. In addition, advantageously simple maintenance can in particular be achieved.

The inner panel unit preferably comprises at least one support element, which is at least partially provided for retention of at least one storage element, in particular the storage element mentioned above, advantageously a storage plate and particularly preferably a shelf. In particular, the support element is provided to at least partially receive a weight force of the storage element and/or a further object, in particular arranged or which can be arranged on the storage element. The support element is particularly preferably provided for at least partial retention of a large number of storage elements, in particular at various levels. In particular, the inner panel unit can also be designed as a support element. Advantageously flexible storage can in particular be achieved hereby. The support element can have, for example, a large number of openings for receiving retaining projections of a storage element, so the storage element can be positioned at different height levels.

A particularly compact arrangement of the inner panel unit and the air exchange unit as well as an advantageous air exchange effect can in particular be achieved if the air exchange unit at least partially, and preferably to at least a large extent, surrounds the inner panel unit, in particular when the inner panel is being viewed perpendicularly.

In a further embodiment of the invention it is proposed that the air exchange unit and the inner panel unit are connected together, in particular fixed to each other, advantageously by means of a positive and/or non-positive connection, preferably a latched connection and/or a screw connection. The air exchange unit particularly advantageously defines at least one additional locating recess inside which the inner panel unit is arranged. Advantageous stability and/or particularly straightforward production in particular can be achieved hereby. It is also possible for the inner panel unit to be fixed additionally or solely to the inner container. The air exchange unit can have a recess inside which the inner panel unit can be fixed to the inner container.

With the above and other objects in view there is also provided, in accordance with the invention, a method for operating a household appliance device. The device comprises an inner container, which has at least one inner panel which at least partially delimits an interior, advantageously a useful space wherein, in particular in at least one method step, air is exchanged by means of an air exchange unit which defines at least two flow channels running at least essentially parallel and in particular spaced apart from each other, each of which channels is, in particular, directly fluidically connected to the to the interior. In particular, efficiency of the household appliance device can be improved hereby. In particular, an interior can advantageously be enlarged, and/or a useful space efficiency improved. Furthermore, an efficient temperature stratification, preferably a convection effect, and particularly advantageously an air circulation, can be achieved. Further components, such as, for example, temperature control and/or fan elements can advantageously be dispensed with, so cost efficiency can advantageously be improved. Furthermore, the inner panel can advantageously be cleaned, in particular since a contamination effect can be reduced by the at least essentially flat inner panel plane. Furthermore, an air exchange unit with an inconspicuous design can in particular be provided which can advantageously be implemented so as to be almost invisible for a user. In addition, the complexity in particular can be reduced, and/or a uniform concept achieved across different appliance ranges.

Other features which are considered as characteristic for the invention are set forth in the appended claims.

Although the invention is illustrated and described herein as embodied in a household appliance device and method for operating a household appliance device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
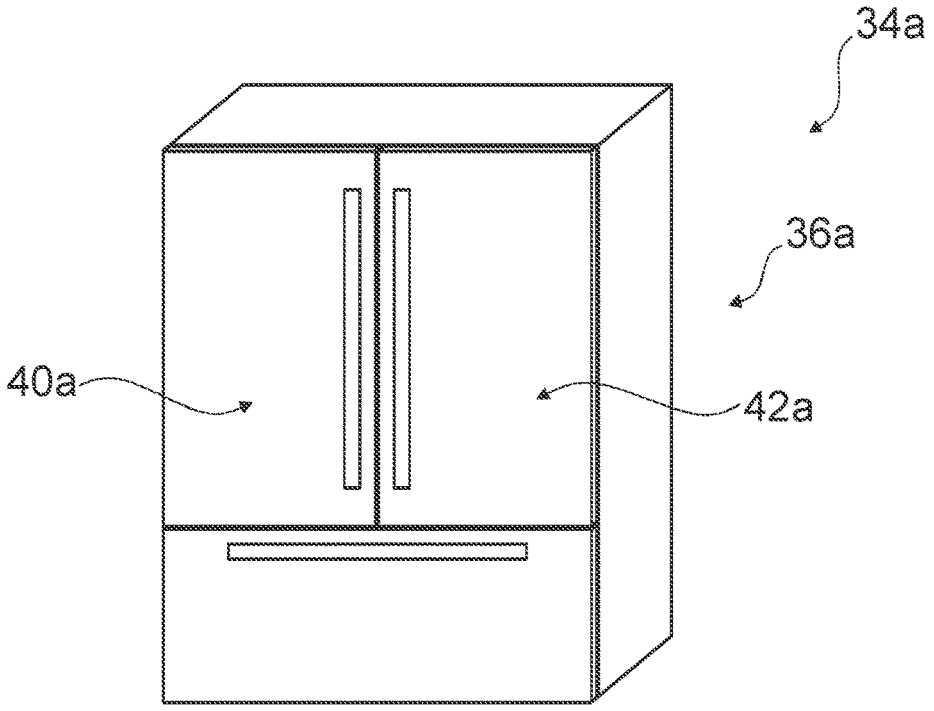
FIG. 1 is a simple perspective view of an exemplary embodiment of a household appliance designed as a household refrigerator having a household appliance device.

Referring now to the figures of the drawing in detail and first, particularly, to FIG. 1 thereof, there is shown an exemplary household appliance 34*a* designed as a household refrigerator in a schematic front perspective view. In the present case the household appliance 34*a* is a floor-mounted appliance. The household appliance 34*a* is therefore designed to be free-standing. In addition, the household appliance 34*a* is designed as a fridge-freezer. The household appliance 34*a* is designed as a French door appliance. Alternatively, it is also conceivable to design a household appliance as a different household refrigerator and/or as a fitted appliance which can in particular be fitted in an assembled state into household furniture. In addition, a household appliance could, in principle, also be designed as a cooking appliance, such as, for example, as an oven.

The household appliance 34*a* comprises a household appliance device. The household appliance device is provided in a known manner to cool food and other chilled goods. For this purpose, the household appliance device comprises an appliance body 36*a*.

Figure 2:
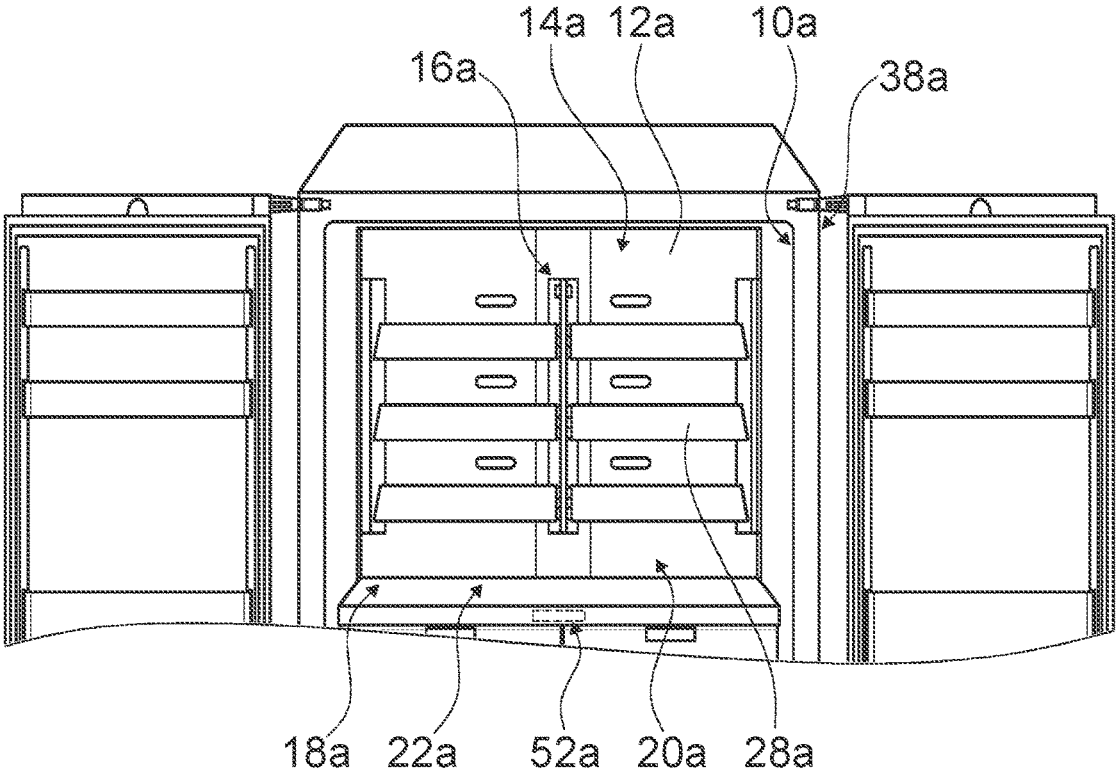
FIG. 2 shows the household appliance having the household appliance device in an inner view, wherein at least one inner panel of an inner container, an inner panel unit and part of an air exchange unit can be seen.

With reference to FIG. 2, the appliance body 36*a* has an outer container 38*a* and an inner container 10*a*. The inner container 10*a* is connected to the outer container 38*a*. In an assembled state the inner container 10*a* is arranged inside the outer container 38*a*. In an assembled state a gap between the inner container 10*a* and the outer container 38*a* is foam-filled in particular for thermal insulation.

The inner container 10*a* is made at least partially from a thermoplastic. The inner container 10*a* is produced and/or molded in a thermoforming process, moreover. The inner container 10*a* has at least one inner panel 12*a*. In the present case the inner panel 12*a* is a back panel. The inner container 10*a* delimits and/or defines an interior 14*a*. The interior 14*a* is designed as a useful space and is used, in particular, for storing food and/or drink. The interior 14*a* has an access opening. The access opening opposes the inner panel 12*a*. Furthermore, in the present case the appliance body 36 has, for example, further inner spaces designed, in particular as freezer spaces.

The household appliance device also comprises at least one appliance closure element 40*a*, 42*a*. In the present case the household appliance device comprises a plurality of appliance closure elements 40*a*, 42*a*, wherein, in particular for the sake of clarity, only two of the appliance closure elements 40*a*, 42*a* are provided with reference numerals. A first appliance closure element 40*a* and a second appliance closure element 42*a* of the appliance closure elements 40*a*, 42*a* are designed as appliance doors. The first appliance closure element 40*a* and the second appliance closure element 42*a* are each provided to close, in at least one operating state, at least one section of the interior 14*a*, in the present case in particular one half each. In the present case the first appliance closure element 40*a* and the second appliance closure element 42*a*, in particular in a closed state, close the interior 14*a* at least essentially completely.

For storing food and/or drink the household appliance device also has at least one storage element 28*a* auf. In the present case the household appliance device has, purely by way of example, six storage elements 28*a*, wherein for the sake of clarity only one of the storage elements 28*a* is provided with a reference numeral in FIG. 2. The storage elements 28*a* are designed as storage plates, in the present case in particular glass plates. The storage elements 28*a* are designed as shelves. The storage elements 28*a* are arranged inside the interior 14*a*. The storage elements 28*a* are distributed over the interior 14*a*. The storage elements 28*a* are arranged at different levels, in particular in the vertical direction and/or in the height direction, of the household appliance 34*a*. In addition, at least two of the storage elements 28*a* are horizontally arranged side by side, in particular in such a way that the storage elements 28*a* are arranged in different sections 18*a*, 20*a* of the interior 14*a*. The storage elements 28*a* are arranged on the inner panel 12*a*. Alternatively or additionally, a household appliance device can also have a bottle holder, a rack and/or a storage container.

Figure 3:
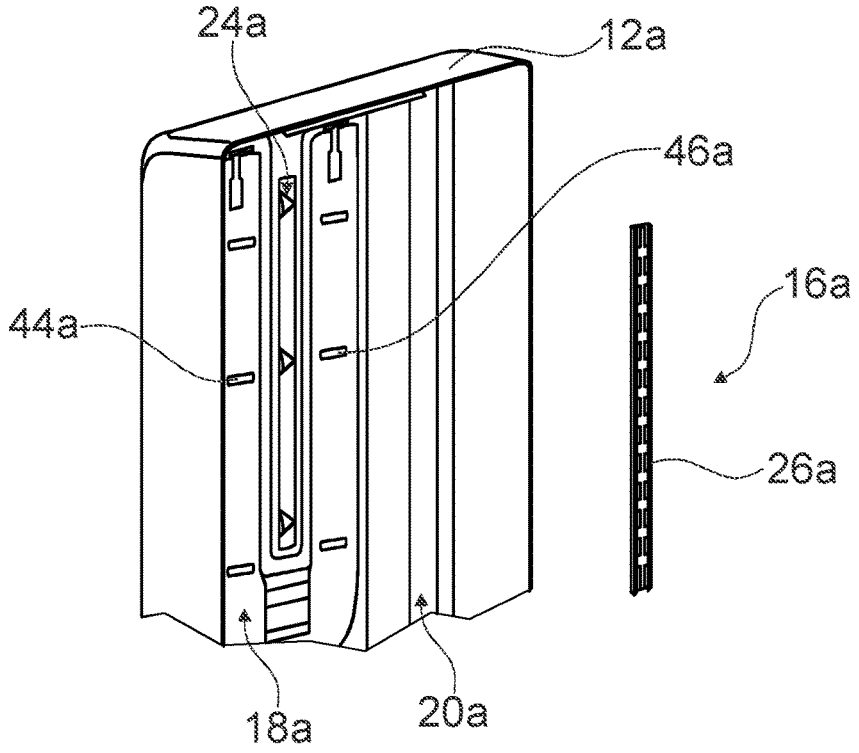
FIG. 3 shows a first side of the inner panel and the inner panel unit in an exploded view.

Furthermore, the household appliance device has an inner panel unit 16*a* (cf. also FIG. 3). The inner panel unit 16*a* is designed separately from the inner panel 12*a*. The inner panel unit 16*a* has an elongate design and defines a direction of longitudinal extension. The direction of longitudinal extension is parallel to the vertical direction and/or height direction of the household appliance 34*a*. The inner panel unit 16*a* is arranged inside the interior 14*a*. The inner panel unit 16*a* is arranged on a side of the inner container 10*a* facing the interior 14*a*. The inner panel unit 16*a* is arranged on the inner panel 12*a*. The inner panel unit 16*a* is arranged, at least when the inner panel 12*a* is being viewed perpendicularly, in a region that is different from an edge region of the inner panel 12*a*. In the present case the inner panel unit 16*a* is arranged centrally on the inner panel 12*a*. The inner panel unit 16*a* is positively and/or non-positively connected to the inner panel 12*a*, in particular the side of the inner panel 12*a* facing the interior 14*a*. In the present case the inner panel unit 16*a* is connected by means of a screw connection to the inner panel 12*a*. The inner panel unit 16*a* is arranged on the inner panel 12*a* such that, at least when the interior 14*a* is being viewed and at least in one region of the inner panel unit 16*a*, the inner panel unit 16*a* is designed at least essentially level with the inner panel 12*a*. In the present case the inner panel 12*a* defines a locating recess 24*a*, corresponding in particular to a shape of the inner panel unit 16, inside which recess the inner panel unit 16*a* is arranged (cf. in particular FIG. 3).

In addition, at least when the inner panel 12*a* is being viewed perpendicularly, the inner panel unit 16*a* conceptually divides the interior 14*a* into a first section 18*a* and a second section 20*a*, arranged in particular horizontally next to the first section 18*a*. The first section 18*a* opposes the first appliance closure element 40*a*. The second section 20*a* opposes the second appliance closure element 42*a*.

The inner panel unit 16*a* is provided, moreover, for at least partial retention of the storage elements 28*a*. For this purpose, the inner panel unit 16*a* comprises at least one support element 26*a*. In the present case the inner panel unit 16*a* comprises exactly one support element 26*a*. The support element 26*a* has a plurality of retaining parts arranged offset in the vertical direction and/or height direction for retention of the storage elements 28. Alternatively, an inner panel unit could, however, also comprise at least two and/or at least three support elements designed separately from each other, which could be associated, for example, with different sections and/or could be arranged mutually offset in the vertical direction and/or height direction. In addition, it is conceivable to design an inner panel unit free from support elements and/or arrange it in a region of an inner panel different from a central region.

Figure 4:
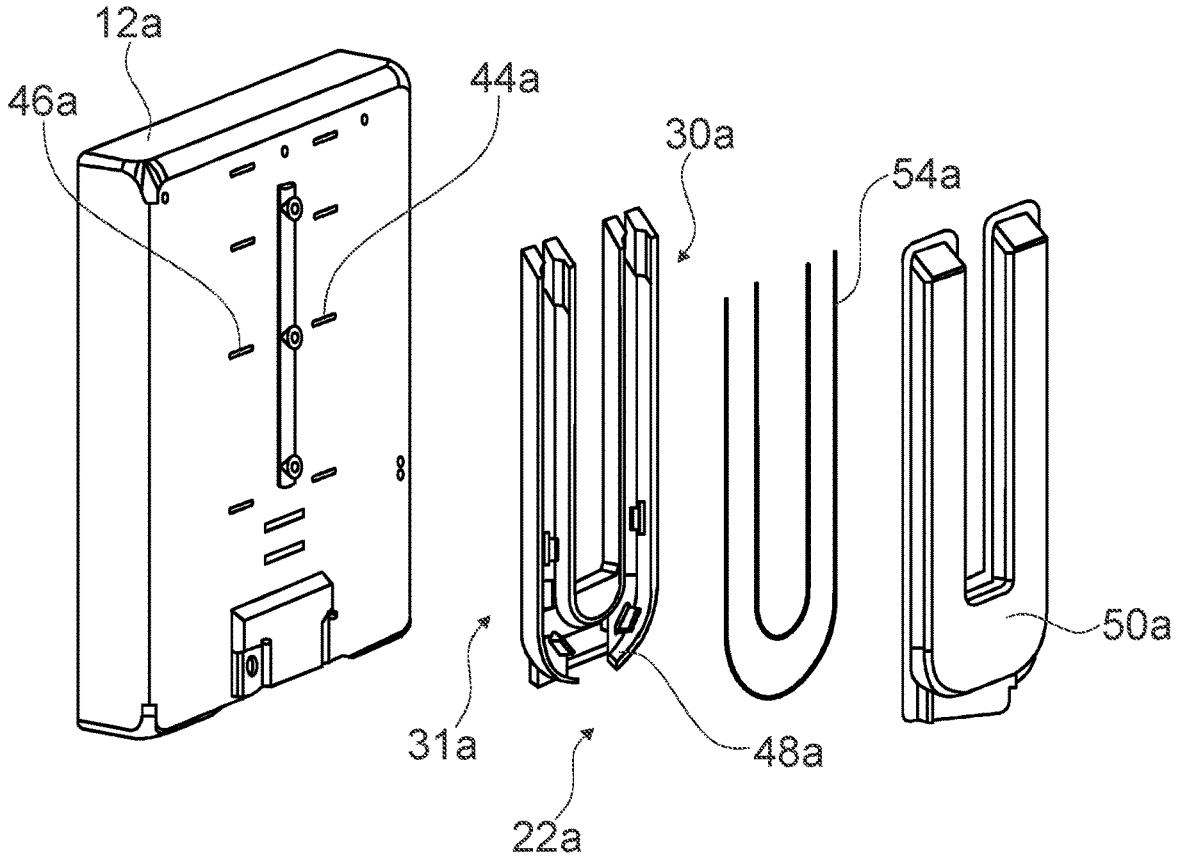
FIG. 4 shows a second side of the inner panel and the air exchange unit in an exploded view.

In particular in order to achieve an advantageous air exchange in the interior 14*a* the household appliance device also comprises an air exchange unit 22*a* (cf. in particular FIG. 4). The air exchange unit 22*a* is essentially designed separately from the inner panel 12*a*. The air exchange unit 22*a* is designed separately from the inner panel unit 16*a*. The air exchange unit 22*a* has an elongate design and defines a further direction of longitudinal extension. The further direction of longitudinal extension is arranged parallel to the vertical direction and/or height direction of the household appliance 34*a*. The air exchange unit 22*a* is arranged to at least a large extent outside of the interior 14*a*. The air exchange unit 22*a* is arranged to at least a large extent in the gap between the inner container 10*a* and the outer container 38*a*. The air exchange unit 22*a* is therefore arranged to at least a large extent on a side of the inner container 10*a* remote from the interior 14*a*. Alternatively, an air exchange unit could, however, also be arranged to at least a large extent and/or completely inside an interior.

Furthermore, the air exchange unit 22*a* is arranged on the inner panel 12*a*. The air exchange unit 22*a* is arranged, at least when the inner panel 12*a* is being viewed perpendicularly, in a region different from the edge region of the inner panel 12*a*. In the present case the air exchange unit 22*a* is arranged in a central region on the inner panel 12*a*. The air exchange unit 22*a* is arranged in a vicinity of the inner panel unit 16*a*. In the present case the air exchange unit 22*a* is arranged in such a way that the air exchange unit 22*a* surrounds the inner panel unit 16*a* to at least a large extent, in particular at least when the inner panel 12*a* is being viewed perpendicularly. The air exchange unit 22*a* is firmly bonded, moreover, to the inner panel 12*a*, in particular the side of the inner panel 12*a* remote from the interior 14*a*. In the present case the air exchange unit 22*a* is connected by means of a glued joint to the inner panel 12*a*. The air exchange unit 22*a* is arranged on the inner panel 12*a* in such a way that the air exchange unit 22*a* is designed, at least when the interior 14*a* is being viewed and at least in one region of the air exchange unit 22*a*, at least essentially level with the inner panel 12*a*. In the assembled state the inner panel 12*a*, the inner panel unit 16*a* and the air exchange unit 22*a* define and/or form a shared inner panel plane and/or an at least essentially flat inner side, in particular back side, of the interior 14*a*.

The air exchange unit 22*a* is also operatively connected to the first section 18*a*. In addition, the air exchange unit 22*a* is operatively connected to the second section 20*a*. Furthermore, the air exchange unit 22*a* is operatively connected to a cooling unit, for example an evaporator unit, of the household appliance 34*a*. The air exchange unit 22*a* is provided at least for an air exchange between the interior 14*a* and the cooling unit.

For this purpose, the air exchange unit 22*a* comprises at least one first air flow opening 44*a*, at least one second air flow opening 46*a*, at least one first flow channel 30*a* and at least one second flow channel 31*a*.

The first air flow opening 44*a* is associated with the first section 18*a*. The first air flow opening 44*a* is connected to the first section 18*a*. The first air flow opening 44*a* is associated with the first flow channel 30*a*. The first air flow opening 44*a* is connected to the first flow channel 30*a*. The first air flow opening 44*a* has an elongate design and defines a direction of longitudinal extension which is oriented perpendicularly to the vertical direction and/or height direction. The first air flow opening 44*a* is punched into the inner panel 12*a* in the present case.

The second air flow opening 46*a* is associated with the second section 20*a*. The second air flow opening 46*a* is connected to the second section 20*a*. The second air flow opening 46*a* is associated with the second flow channel 31*a*. The second air flow opening 46*a* is connected to the second flow channel 31*a*. The second air flow opening 46*a* is spaced apart from the first air flow opening 44*a*. The second air flow opening 46*a* is elongate in design and defines a direction of longitudinal extension which is oriented perpendicularly to the vertical direction and/or height direction. The second air flow opening 46*a* is punched into the inner panel 12*a* in the present case.

The first flow channel 30*a* and the second flow channel 31*a* are each fluidically connected by the first air flow opening 44*a* and the second air flow opening 46*a* to the interior 14*a*. The flow channels 30*a*, 31*a* have main directions of extension oriented parallel to each other, in particular in such a way that the flow channels 30*a*, 31*a* run fluidically parallel to each other. The flow channels 30*a*, 31*a* are arranged in such a way that the inner panel unit 16*a* is arranged, at least when the inner panel 12*a* is being viewed perpendicularly, between the flow channels 30*a*, 31*a*. In a region facing a standing region of the household appliance 34*a* the flow channels 30*a*, 31*a* are connected to each other, moreover, and therefore form a shared flow channel. The shared flow channel is U-shaped at least in certain sections. In the present case the air exchange unit 22*a* comprises, moreover, a plurality of further first air flow openings and a plurality of further second air flow openings which are connected to the flow channels 30*a*, 31*a* to which no reference numeral has been assigned, however, for the sake of clarity.

In addition, the air exchange unit 22*a* comprises an air inlet opening 52*a* for cooling air. The air inlet opening 52*a* is provided for inflow of an air flow into the interior 14*a*. The air inlet opening 52*a* is connected to a cooling unit (not shown), for example an evaporator unit, of the household appliance 34*a*. In addition, the air inlet opening 52*a* is connected to the flow channels 30*a*, 31*a* and in particular the region facing the standing region of the household appliance 34*a*.

Furthermore, the air exchange unit 22*a* in the present case comprises at least two air exchange elements 48*a*, 50*a*. The air exchange elements 48*a*, 50*a* are arranged completely outside of the interior 14*a*. The air exchange elements 48*a*, 50*a* are arranged completely in the gap between the inner container 10*a* and the outer container 38*a*. The air exchange elements 48*a*, 50*a* are therefore arranged completely on the side of the inner container 10*a* remote from the interior 14*a*. The air exchange elements 48*a*, 50*a* are sealed relative to each other and/or relative to the inner panel 12*a* by means of a seal 54*a* of the air exchange unit 22*a*. The air exchange elements 48*a*, 50*a*, together with the inner panel 12*a*, delimit in particular the side of the inner panel 12*a* remote from the interior 14*a*, the flow channels 30*a*, 31*a*. A first air exchange element 48*a* of the air exchange elements 48*a*, 50*a* is made from expanded polystyrene. The first air exchange element 48*a* is at least essentially U-shaped. A second air exchange element 50*a* of the air exchange elements 48*a*, 50*a* is made from plastics material. The second air exchange element 50*a* is at least essentially U-shaped. The second air exchange element 50*a* is used for protection, for retention and/or for covering the first air exchange element 48*a*. Alternatively, an air exchange unit could also be designed in one piece and/or comprise exactly one air exchange element. It is also conceivable to manufacture air exchange elements from any other different materials.

FIGS. 5 to 8 show further exemplary embodiments of the invention. The following descriptions and the drawings are essentially limited to the differences between the exemplary embodiments, wherein in respect of components with the same name, in particular in respect of components with identical reference numerals, reference can basically also be made to the drawings and/or the description of the other exemplary embodiments, in particular FIGS. 1 to 4. For distinguishing the exemplary embodiments, the letter a is appended to the reference numeral of the exemplary embodiment in FIGS. 1 to 4. In the exemplary embodiments of FIGS. 5 to 8 the letter a is replaced by the letters b and c.

Figure 5:
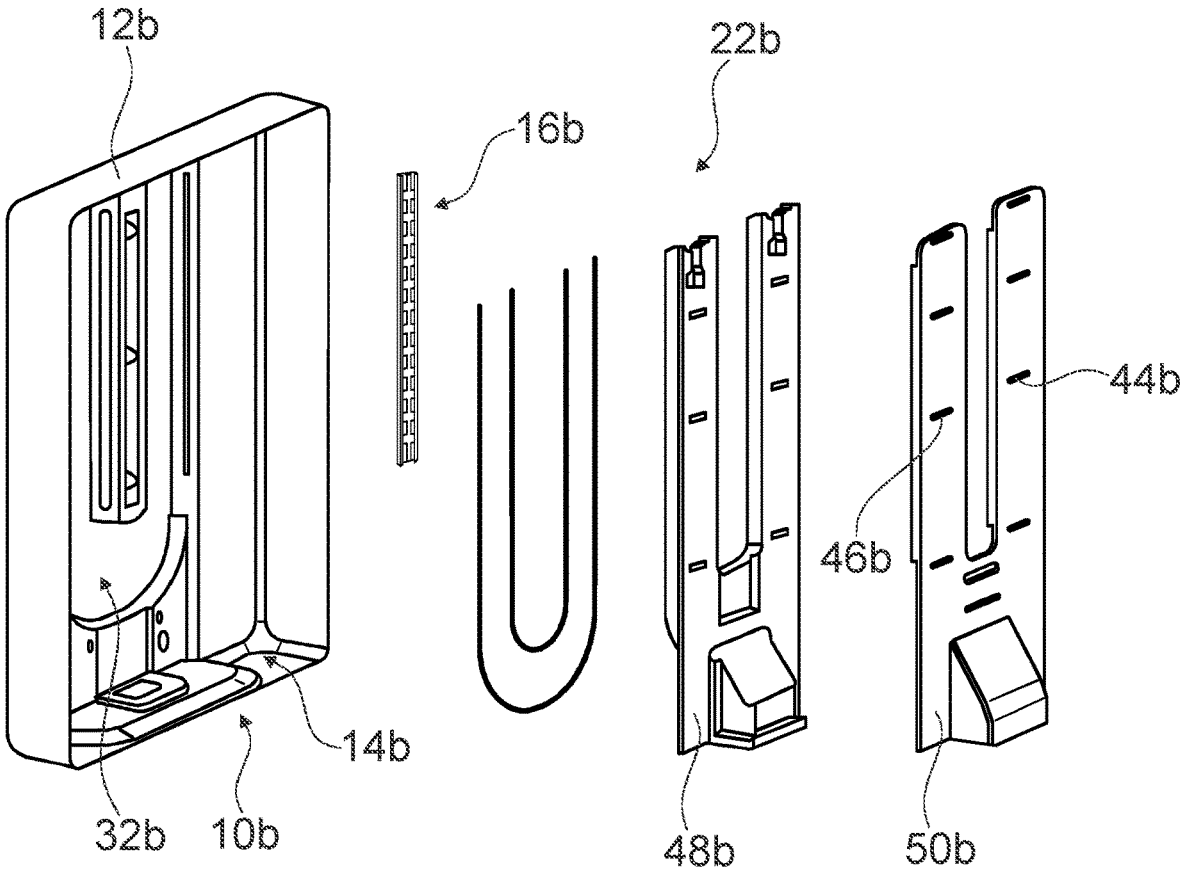
FIG. 5 shows a further exemplary embodiment of a household appliance device, wherein a first side of an inner panel, an inner panel unit and an air exchange unit are shown in an exploded view.
Figure 6:
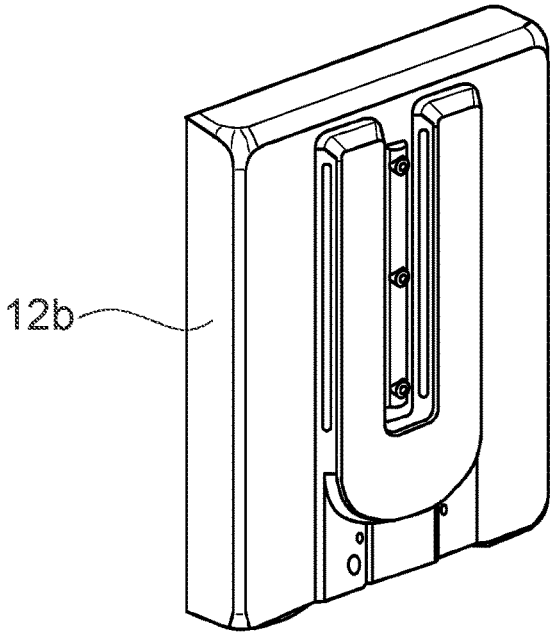
FIG. 6 shows a second side of the inner panel from FIG. 5.

FIGS. 5 and 6 show a further exemplary embodiment of the invention. The letter b is appended to the exemplary embodiment in FIGS. 5 and 6. The further exemplary embodiment in FIGS. 5 and 6 differs from the previous exemplary embodiment at least essentially by way of an arrangement of an air exchange unit 22*b*.

In the present case the air exchange unit 22*b*, and in particular air exchange elements 48*b*, 50*b* of the air exchange unit 22*b*, is arranged completely inside an interior 14*b*. The air exchange unit 22*b* is arranged completely on a side of an inner container 10*b* facing the interior 14*b*. The air exchange unit 22*a* is, moreover, connected positively and/or non-positively to an inner panel 12*b*, in particular a side of the inner panel 12*b* facing the interior 14*b*. In the present case the air exchange unit 22*b* is connected by means of a latched connection to the inner panel 12*b*. The air exchange unit 22*b* is arranged on the inner panel 12*b* in such a way that, at least when the interior 14*b* is being viewed and at least in one region of the air exchange unit 22*b*, the air exchange unit 22*b* is designed at least essentially level with inner panel 12*b*. The inner panel 12*b* defines a further locating recess 32*b*, corresponding in particular to a shape of the air exchange unit 22*b*, inside which recess the air exchange unit 22*b* is arranged. In the present case the inner panel 12*b*, an inner panel unit 16*b* and the air exchange unit 22*b* in the assembled state define and/or form a shared inner panel plane and/or an at least essentially flat inner side, in particular back side, of the interior 14*b*.

In addition, at least one first air flow opening 44*b* and one second air flow opening 46*b* are introduced into the air exchange unit 22*b* and in particular the air exchange elements 48*b*, 50*b* of the air exchange unit 22*b*.

Figure 7:
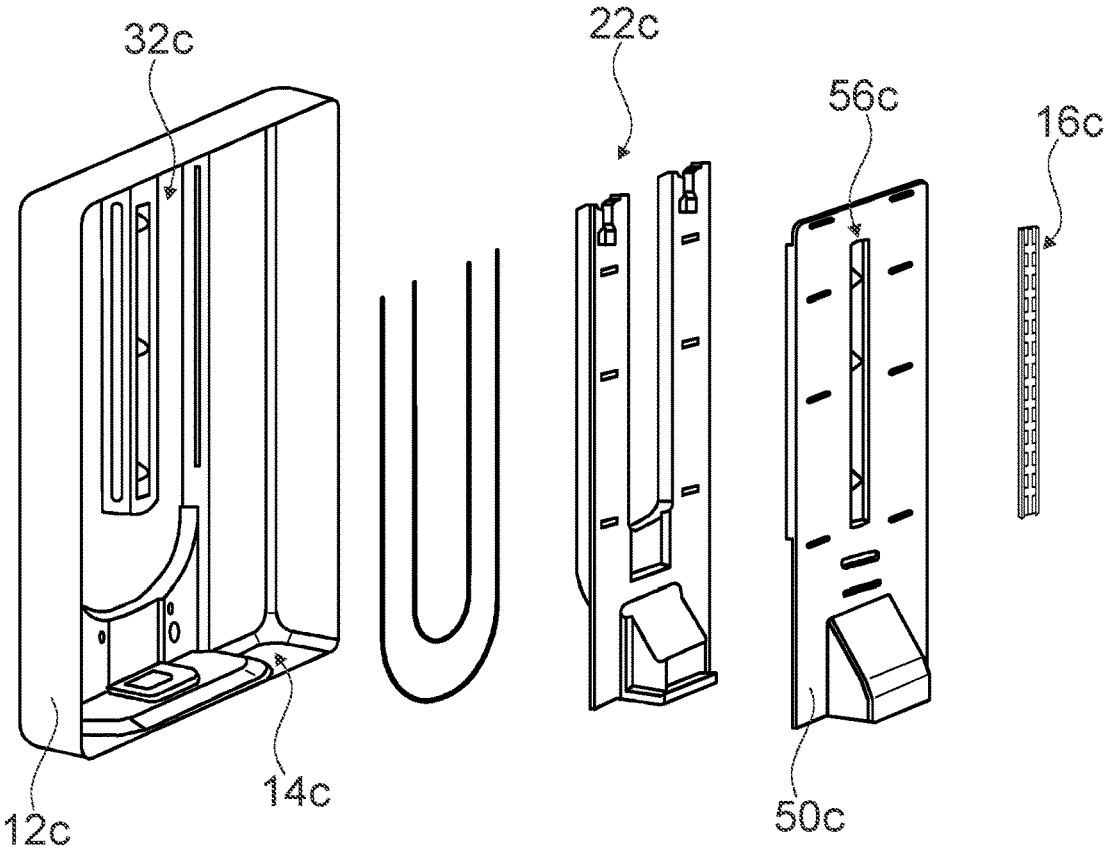
FIG. 7 shows a further exemplary embodiment of a household appliance device, wherein a first side of an inner panel, an inner panel unit and an air exchange unit are shown in an exploded view.
Figure 8:
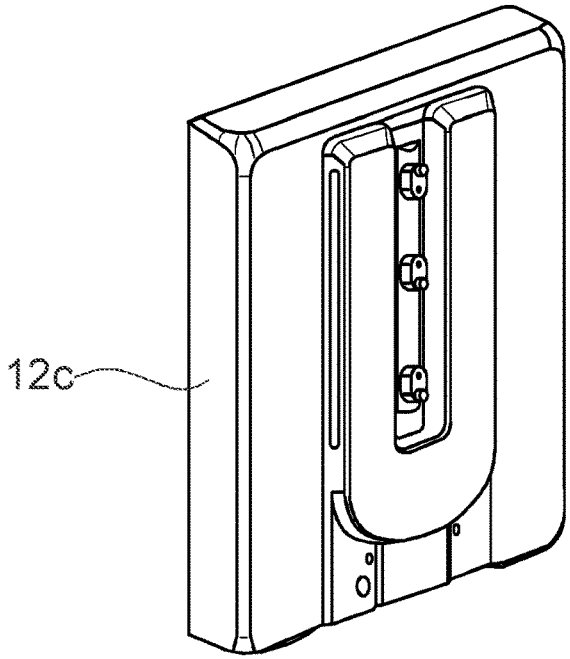
FIG. 8 shows a second side of the inner panel from FIG. 7.

FIGS. 7 and 8 show a further exemplary embodiment of the invention. The letter c is appended to the exemplary embodiment in FIGS. 7 and 8. The further exemplary embodiment in FIGS. 7 and 8 differs from the previous exemplary embodiments at least essentially by way of an arrangement of an inner panel unit 16*c*.

In the present case the inner panel unit 16*c* is arranged on and, in particular, fixed to an air exchange unit 22*c*. The inner panel unit 16*c* is positively and/or non-positively connected to the air exchange unit 22*c*, in particular a side of the air exchange unit 22*c* facing an interior 14*c*. In the present case the inner panel unit 16*c* is connected by means of a screw connection to a second air exchange element 50*c* of the air exchange unit 22*c*. The second air exchange element 50*c* is plate-like at least in certain sections.

The air exchange unit 22*c* and the inner panel unit 16*c* are arranged on an inner panel 12*c* in such a way that the air exchange unit 22*c* and the inner panel unit 16*c* are designed, at least when the interior 14*c* is being viewed, at least essentially level with the inner panel 12*c*. In the present case the inner panel 12*c* defines a further locating recess 32*c*, corresponding in particular to the shape of the air exchange unit 22*c*, inside which recess the air exchange unit 22*c* is arranged. In addition, the air exchange unit 22*c* defines an additional locating recess 56*c*, corresponding in particular to a shape of the inner panel unit 16*c*, inside which recess the inner panel unit 16*c* is arranged.

The following is a summary list of reference numerals and the corresponding structure used in the above description of the invention:

10 inner container
12 inner panel
14 interior
16 inner panel unit
18 section
20 section
22 air exchange unit
24 locating recess
26 support element
28 storage element
30 flow channel
31 flow channel
32 locating recess
34 household appliance
36 appliance body
38 outer container
40 appliance closure element
42 appliance closure element
44 air flow opening
46 air flow opening
48 air exchange element
50 air exchange element
52 air inlet opening
54 seal
56 locating recess

The invention claimed is:

1. A household appliance device, comprising:

an inner container having an inner panel at least partially delimiting an interior;

an air exchange unit defining at least two flow channels, said at least two flow channels running fluidically substantially parallel, at least in certain sections thereof, and each fluidically communicating with the interior and fluidically separated from one another.

2. The household appliance device according to claim 1 configured as a household refrigerator.

3. The household appliance device according to claim 1, wherein said inner panel is a back panel of said inner container.

4. The household appliance device according to claim 1, wherein, on viewing the interior, said air exchange unit is substantially level with said inner panel.

5. The household appliance device according to claim 1, wherein said air exchange unit is arranged on a side of said inner container facing the interior.

6. The household appliance device according to claim 1, wherein said air exchange unit is arranged on a side of said inner container remote from the interior.

7. The household appliance device according to claim 1, wherein said inner panel is formed with at least one locating recess and said air exchange unit is arranged in said at least one locating recess.

8. The household appliance device according to claim 1, which further comprises an inner panel unit, which, when said inner panel is viewed perpendicularly, is arranged between said flow channels, and which, when the interior is viewed, is substantially level with said inner panel.

9. The household appliance device according to claim 8, wherein said inner panel unit is arranged at least partially on a side of said inner container facing the interior.

10. The household appliance device according to claim 8, wherein said inner panel is formed with at least one further locating recess and said inner panel unit is arranged inside said at least one further locating recess.

11. The household appliance device according to claim 8, wherein said inner panel unit comprises at least one support element which is at least partially provided for retaining at least one storage element.

12. The household appliance device according to claim 8, wherein said air exchange unit at least partially encompasses said inner panel unit.

13. The household appliance device according to claim 8, wherein said air exchange unit and said inner panel unit are connected to each other.

14. A household appliance, comprising at least one household appliance device according to claim 1.

15. A method for operating a household appliance device, the method comprising:

providing a household appliance device with an inner container which has at least one inner panel that delimits an interior at least partially; and exchanging air by way of an air exchange unit that is formed with two or more flow channels that run substantially parallel to one another and that communicate fluidically with the interior and fluidically separated from one another.

16. The method according to claim 15 wherein the providing step comprises providing the household appliance device according to claim 1.

* * * * *